US009578963B2

(12) United States Patent
Mayer

(10) Patent No.: US 9,578,963 B2
(45) Date of Patent: Feb. 28, 2017

(54) COMBINATION VANITY, DRESSER DRAWER AND CLOSET

(71) Applicant: Robert Mayer, Boca Raton, FL (US)

(72) Inventor: Robert Mayer, Boca Raton, FL (US)

( * ) Notice: Subject to any disclaimer, the term of this patent is extended or adjusted under 35 U.S.C. 154(b) by 50 days.

(21) Appl. No.: 14/795,697

(22) Filed: Jul. 9, 2015

(65) Prior Publication Data

US 2017/0007018 A1 Jan. 12, 2017

(51) Int. Cl.

| | |
|---|---|
| ***A47B 81/00*** | (2006.01) |
| ***A47B 83/00*** | (2006.01) |
| ***A47B 61/00*** | (2006.01) |
| ***A47B 63/00*** | (2006.01) |
| ***A47B 67/00*** | (2006.01) |
| ***A47B 67/04*** | (2006.01) |
| ***A47B 96/16*** | (2006.01) |

(52) U.S. Cl.

CPC ..... *A47B 83/001* (2013.01); *A47B 61/003* (2013.01); *A47B 63/00* (2013.01); *A47B 67/005* (2013.01); *A47B 67/04* (2013.01); *A47B 81/00* (2013.01); *A47B 96/16* (2013.01); *A47B 2083/003* (2013.01); *A47B 2200/0084* (2013.01); *A47B 2200/12* (2013.01); *A47B 2220/0091* (2013.01)

(58) Field of Classification Search

CPC ..... A47B 61/003; A47B 63/00; A47B 67/005; A47B 67/04; A47B 81/00; A47B 83/001; A47B 96/16; A47B 2083/003; A47B 2200/0084; A47B 2200/12; A47B 2220/0091

See application file for complete search history.

(56) References Cited

U.S. PATENT DOCUMENTS

| | | | | | |
|---|---|---|---|---|---|
| 122,337 | A * | 1/1872 | Thompson | A47B 67/005 312/205 |
| 888,104 | A * | 5/1908 | Lind | A47B 53/00 211/134 |
| 1,435,160 | A | 11/1922 | Hoegemann | |
| 1,700,924 | A * | 2/1929 | Cushman | D05B 91/14 108/28 |
| 2,515,459 | A * | 7/1950 | Martin | A47B 67/005 312/228 |

(Continued)

FOREIGN PATENT DOCUMENTS

| | | | | |
|---|---|---|---|---|
| DE | 377137 C | * | 6/1923 | A47B 67/005 |
| FR | 614315 A | * | 12/1926 | A47B 67/005 |

(Continued)

*Primary Examiner* — Daniel J Troy
*Assistant Examiner* — Ryan A Doyle
(74) *Attorney, Agent, or Firm* — Mark Terry

(57) ABSTRACT

A furniture apparatus includes a rectangular shaped housing having an open side, a washing vessel, including a faucet, located within the housing, a plurality of drawers located under the washing vessel and within the housing, an electrical socket located above the washing vessel and within the housing, double doors hingedly coupled to the housing and configured to move between an open position, wherein the open side is unobstructed by the double doors, and a closed position, wherein the double doors completely occlude the open side, at least one storage shelf located within an interior of each of the double doors, and at least one storage container located within an interior of at least one of the double doors.

11 Claims, 15 Drawing Sheets

(56) References Cited

U.S. PATENT DOCUMENTS

| | | | | | |
|---|---|---|---|---|---|
| D251,256 | S | | 3/1979 | Newburger | |
| 4,669,790 | A | * | 6/1987 | Briggs | A47B 21/03 312/223.3 |
| 5,485,931 | A | | 1/1996 | Barr | |
| 5,522,502 | A | | 6/1996 | Orr | |
| D376,496 | S | * | 12/1996 | Kelley | A47B 21/00 D6/664 |
| 5,678,905 | A | * | 10/1997 | Kelley | A47B 21/00 312/196 |
| 5,727,701 | A | | 3/1998 | Rhoades | |
| 5,842,758 | A | * | 12/1998 | Kelley | A47B 21/00 312/196 |
| 5,867,847 | A | | 2/1999 | Klawitter | |
| 6,502,254 | B1 | | 1/2003 | Menna | |
| D533,925 | S | | 12/2006 | Mayer | |
| 7,594,706 | B2 | | 9/2009 | Styka | |
| 7,651,178 | B2 | * | 1/2010 | Greiner | A47B 67/02 248/140 |
| 7,712,849 | B2 | * | 5/2010 | Jakins | A47B 83/001 312/310 |
| 7,721,364 | B2 | * | 5/2010 | Pearson | A47B 77/08 312/228 |
| 7,802,327 | B1 | | 9/2010 | Moceri | |
| 8,087,735 | B1 | * | 1/2012 | Rheault | A47B 87/00 312/109 |
| 8,696,076 | B2 | * | 4/2014 | Karg | E05D 15/262 160/210 |
| 2005/0099101 | A1 | | 5/2005 | Lowe | |
| 2009/0001860 | A1 | * | 1/2009 | Marashi | A47B 21/00 312/223.3 |
| 2011/0115351 | A1 | * | 5/2011 | McManic | A47B 45/00 312/270.1 |
| 2011/0145988 | A1 | | 6/2011 | Le Duff | |
| 2012/0161597 | A1 | * | 6/2012 | Daniels | A47B 21/00 312/237 |
| 2012/0298450 | A1 | | 11/2012 | Sanz | |
| 2015/0070867 | A1 | * | 3/2015 | Head | A47B 88/0044 361/809 |

FOREIGN PATENT DOCUMENTS

| | | | | | |
|---|---|---|---|---|---|
| FR | 641634 | A | * | 8/1928 | A47B 67/005 |
| GB | 191229542 | A | * | 0/1913 | A47B 67/005 |

* cited by examiner

COMBINATION VANITY, DRESSER DRAWER AND CLOSET

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present invention relates to the field of home and commercial furniture, and more specifically to closets, vanities, dresser drawers and shelves.

BACKGROUND

Home and commercial furniture refers to the movable objects in typical homes and commercial spaces intended to support various human activities such as seating (e.g., chairs, stools and sofas), sleeping (e.g., beds) and performing bathroom activates (e.g., vanity, closet, etc.). Home furniture is also used to hold objects at a convenient height for work (as horizontal surfaces above the ground, such as tables and desks), or to store things (e.g., cupboards and shelves). Conventional home furniture can be a product of design but mainly fills a functional role for the typical consumer.

One of the problems associated with conventional home and commercial furniture arises when space is minimal and furniture must fit in small areas. This is a common problem in large metropolitan cities, where rooms are typically smaller than in less-populated areas, as well as in hotel rooms, where space is limited. Lack of space for conventional furniture is also an issue on private jets, other aircraft, cruise ships and other watercraft, where sleeping chambers and staterooms provide a smaller sleeping and bathroom area for individuals. When dealing with smaller living areas, it can be difficult to find furniture that fits in said areas. It can be especially difficult to find furniture to fit in small areas that have irregular shapes, which is often the case on cruise ships and other watercraft. This is compounded by the fact that most conventional furniture is designed and manufactured for larger spaces and are designed to serve one function only.

As a result, there exists a need for improvements over the prior art and more particularly for a more efficient and space-saving solution to the various home furnishings used by consumers in a typical home, hotel room, cabin, stateroom or apartment.

SUMMARY OF THE INVENTION

A furniture apparatus is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, the furniture apparatus includes a rectangular shaped housing having an open side, a washing vessel, including a faucet, located within the housing, a plurality of drawers located under the washing vessel and within the housing, an electrical socket located above the washing vessel and within the housing, double doors hingedly coupled to the housing and configured to move between an open position, wherein the open side is unobstructed by the double doors, and a closed position, wherein the double doors completely occlude the open side, at least one storage shelf located within an interior of each of the double doors, and at least one storage container located within an interior of at least one of the double doors.

In another embodiment, the furniture apparatus includes a rectangular shaped housing having an open side, a horizontal planar divider that divides an inner volume of the housing into a top portion and a bottom portion, a washing vessel, including a faucet, located within the top portion of the housing, an electrical socket located within the top portion of the housing, a plurality of drawers located within the bottom portion of the housing, double doors hingedly coupled to the housing and configured to move between an open position, wherein the top portion of the housing is unobstructed by the double doors, and a closed position, wherein the double doors completely occlude the top portion of the housing, at least one storage shelf located within an interior of at least one of the double doors, and at least one storage container located within an interior of at least one of the double doors.

In yet another embodiment, the furniture apparatus includes a substantially rectangular shaped housing having an open side, a vertical planar divider that divides an inner volume of the housing into a left portion and a right portion, a horizontal planar divider that divides the right portion of the inner volume of the housing into a top portion and a bottom portion, a washing lavatory or vessel, including a faucet, located within the top portion of the housing, an electrical socket located within the top portion of the housing, a plurality of drawers located in the bottom portion of the housing, at least one storage container located in the bottom portion of the housing, a horizontal rod located in the left portion of the housing, the rod for hanging clothes hangers, a door hingedly coupled to the housing and configured to move between an open position, wherein the left portion is unobstructed by the door, and a closed position, wherein the door completely occludes the left portion, and at least one storage shelf located within an interior of the door.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 3:
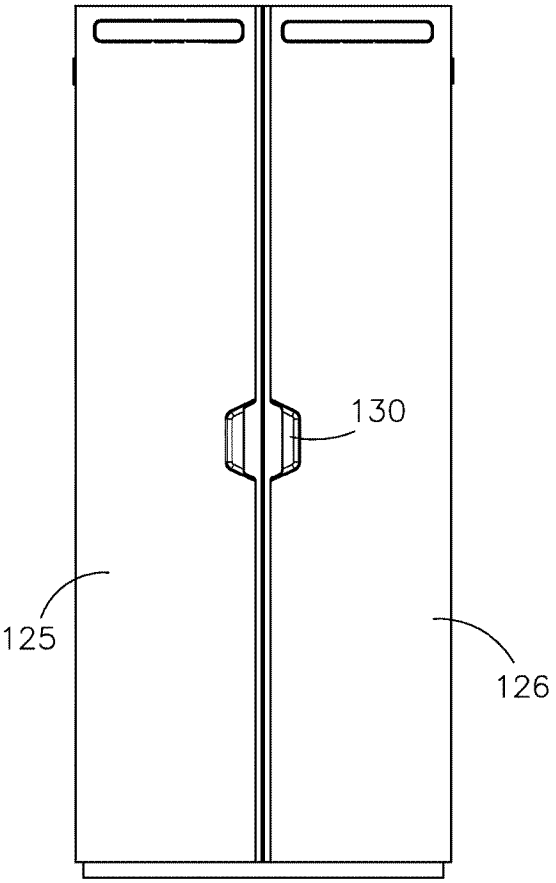
FIG. 3 is a front view of the furniture apparatus comprising double doors in the closed position, according to one embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a furniture apparatus that combines several pieces of furniture (such as a vanity, dresser drawer, and closet or wardrobe), in order to optimize space and provide a solution when space is minimal and furniture must fit in small areas, such as in apartments, hotels rooms, sleeping chambers and staterooms. The disclosed embodiments further improve over the prior art by providing a small furniture apparatus that fits effortlessly in small areas that have irregular shapes, such as on cruise ships and other watercraft. Additionally, the invention improves over the prior art by providing a furniture apparatus that is easily and inexpensively fabricated, while using a minimal number of parts. Finally, the invention improves over the prior art by providing a furniture apparatus that is minimalistic in design and provides an uncluttered and simple view when the doors are closed.

Figure 2:
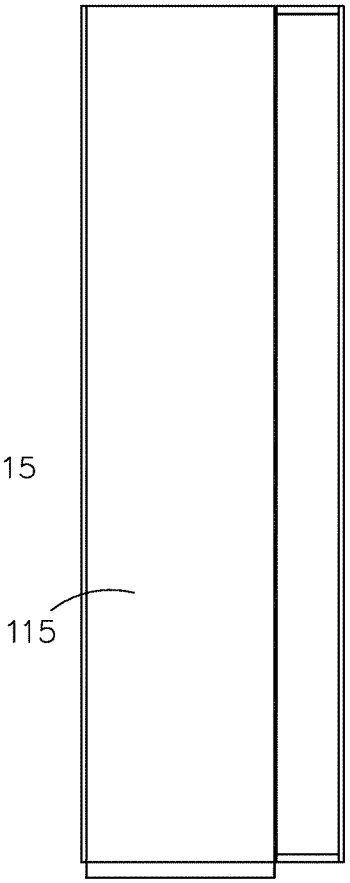
FIG. 2 is a side view of the furniture apparatus comprising double doors in a closed position, according to one embodiment.
Figure 1:
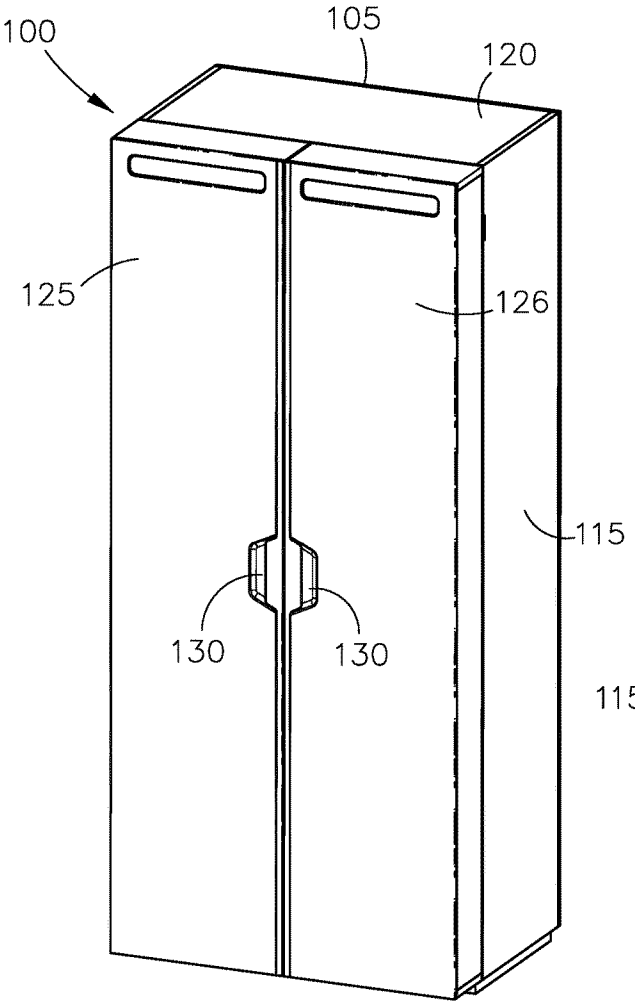
FIG. 1 is a perspective view of a furniture apparatus comprising double doors in a closed position, according to one embodiment.
Figure 6:
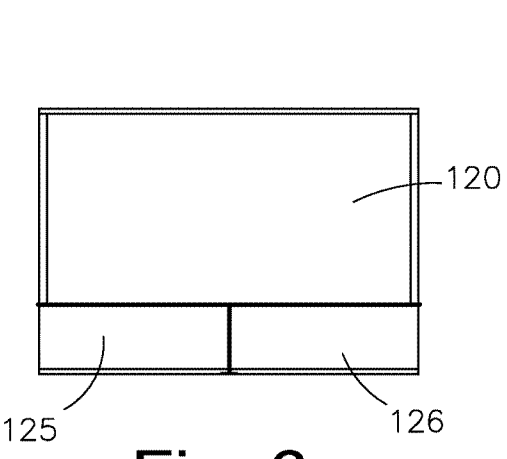
FIG. 6 is a top view of the furniture apparatus comprising double doors in the closed position, according to one embodiment.
Figure 7:
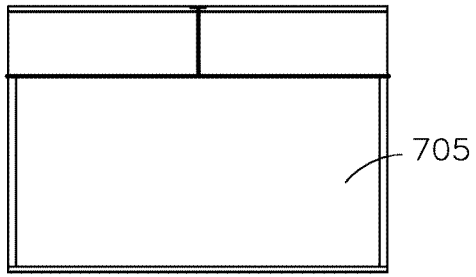
FIG. 7 is a bottom view of the furniture apparatus comprising double doors in the closed position, according to one embodiment.
Figure 5:
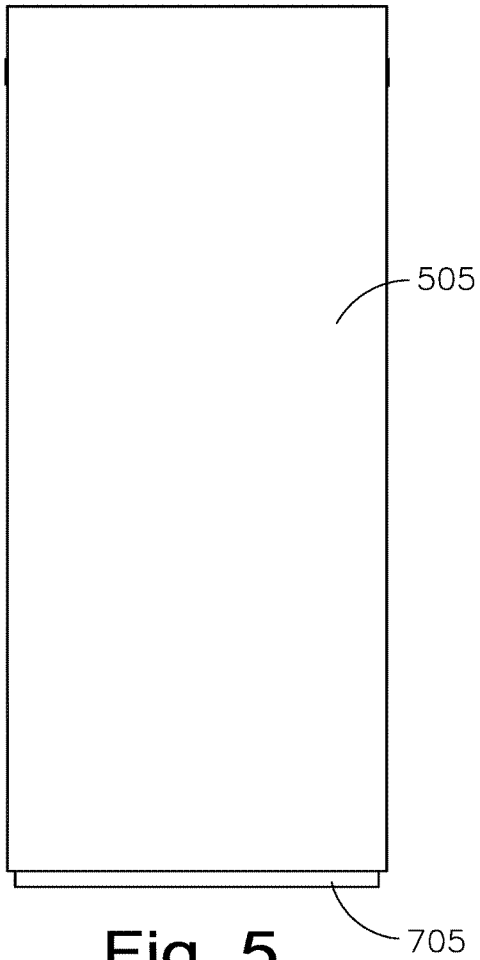
FIG. 5 is a back or rear view of the furniture apparatus comprising double doors in the closed position, according to one embodiment.
Figure 4:
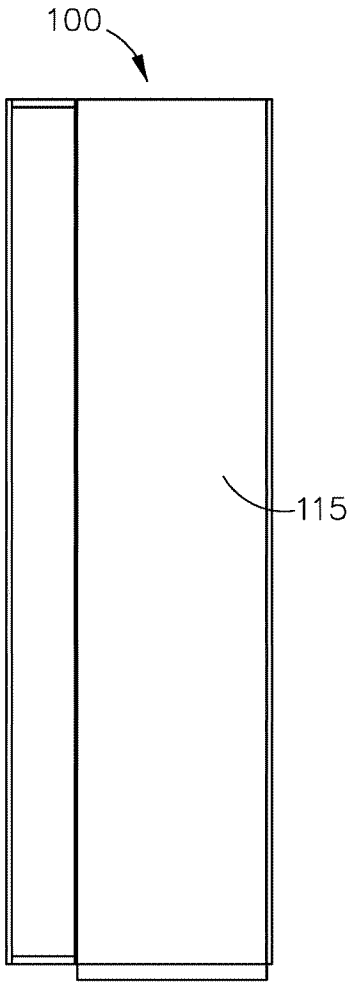
FIG. 4 is a second side view of the furniture apparatus comprising double doors in the closed position, according to one embodiment.

Referring now to the Figures, FIG. 1 is a perspective view of a furniture apparatus 100 comprising double doors in a closed position, according to one embodiment. FIG. 2 is a side view of the furniture apparatus, FIG. 3 is a front view of the furniture apparatus, FIG. 4 is a second side view, FIG. 5 is a back or rear view, FIG. 6 is a top view and FIG. 7 is a bottom view of the furniture apparatus.

FIGS. 1-7 will be discussed together. The furniture apparatus 100 is designed to optimize the use of space by combining various furniture functions in one furniture device, and can be used inside of a home, apartment, hotel room, stateroom, office building, etc., or any dwelling where space is at a premium and the consumer desires to save space. The furniture apparatus 100 comprises a rectangular shaped housing 105. In other embodiments (not shown) the furniture apparatus may comprise a housing defining a square shape, arch shape, circular shaped body, etc. In the present embodiment, the rectangular shaped housing in FIGS. 1-21 has an open side, or front side, opposing a back panel 505, and a top panel 120 opposing a bottom panel 705 (better illustrated in FIG. 7), a first elongated side panel 115 opposing a second elongated side panel 115. The panels of the housing define an interior or volume. In FIGS. 1-11, the rectangular shaped housing includes a pair of double doors 125, 126 hingedly coupled to an edge of the side panels of the housing. Each of the doors may include a handle 130 for applying force such that the doors can be moved between an open and closed position. The handles may be affixed to each door or may be integral with each door.

In FIGS. 1-11, which comprise a first embodiment of said furniture apparatus, the doors span from the top to the bottom of the front side. The doors are configured to move between a closed position (illustrated in FIGS. 1-7) and an open position (illustrated in FIGS. 8-11). Each of the panels, doors and other components of the housing may comprise materials such as wood, plastic, alloy, aluminum, brass, metal, or any combination thereof. Additionally, other materials may be used to those skilled in the art and are within the spirit and scope of the invention. The double doors comprise a first door hingedly coupled to a left side of the housing, and a second door hingedly coupled to a right side of the housing, wherein a vertical length of the first and second doors is coextensive with a vertical length of the housing 105.

Figure 8:
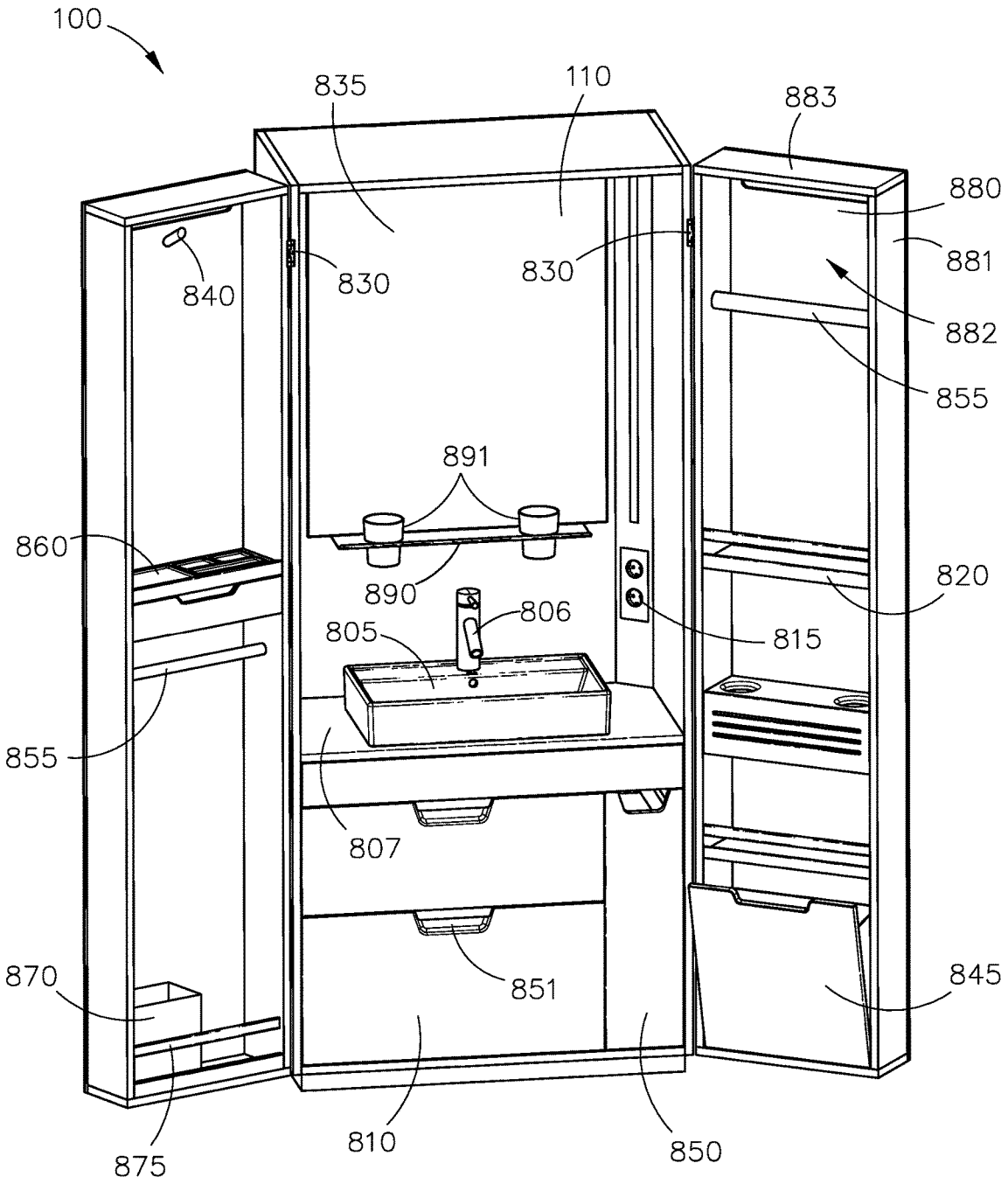
FIG. 8 is a perspective view of the furniture apparatus comprising double doors in an open position and having a plurality of drawers in a closed position and one storage container in an open position, according to one embodiment.
Figure 11:
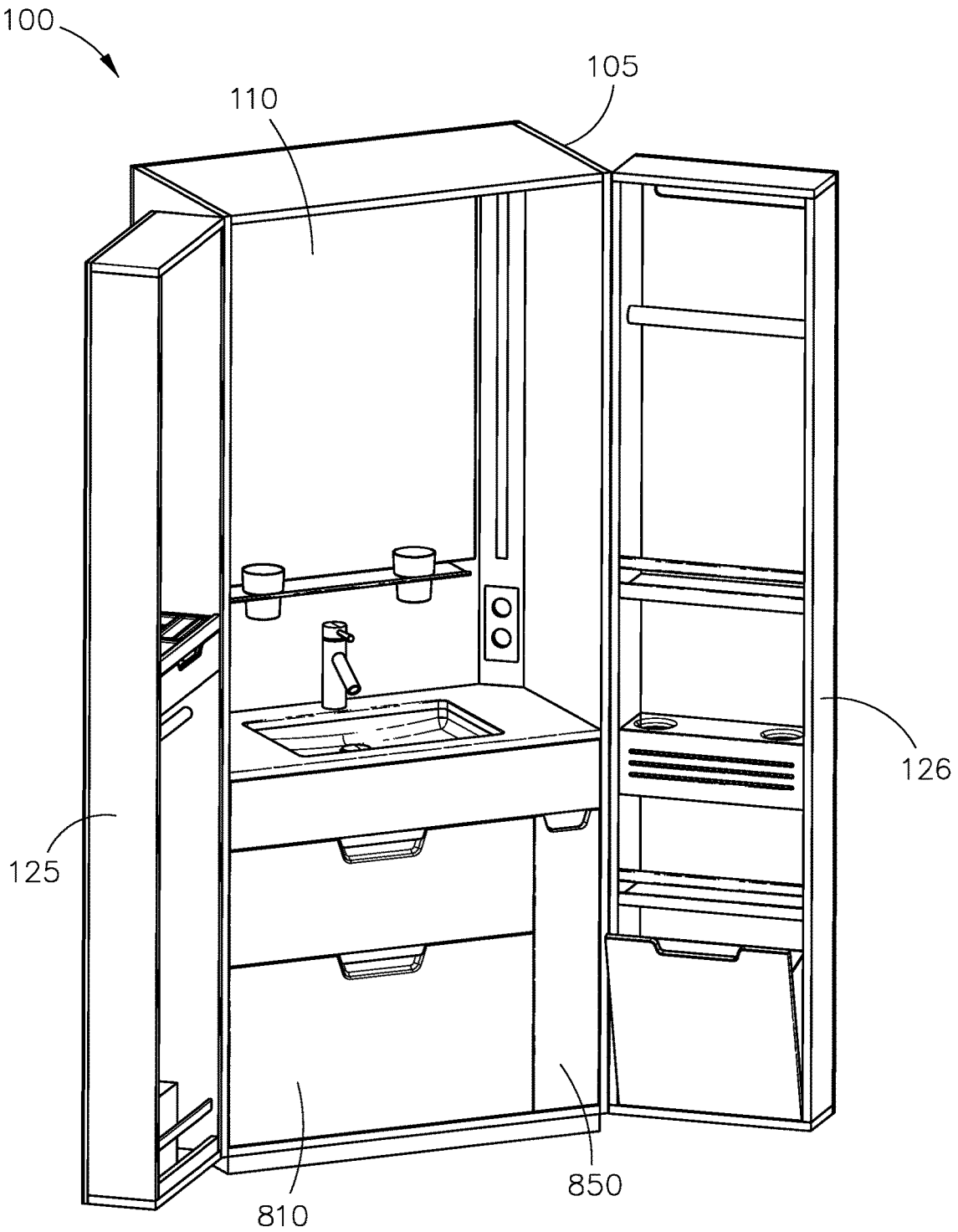
FIG. 11 is another perspective view of the furniture apparatus comprising double doors in an open position, having a plurality of drawers in a closed position and one storage container in an open position, according to one embodiment.

FIGS. 8 and 11 are perspective views of the furniture apparatus comprising double doors in an open position and having a plurality of drawers 810 within the interior of the housing in a closed position. In the closed position the hingedly coupled double doors are coupled to the housing by hinges 830, such that the double doors completely occlude the front or open side 110 of the housing. When in the closed position, interior components of the furniture apparatus are hidden from view. When the double doors are in the closed position, all components located with the housing, and all components located within the interior of the double doors, are hidden from view for the exterior of the apparatus.

Figure 9:
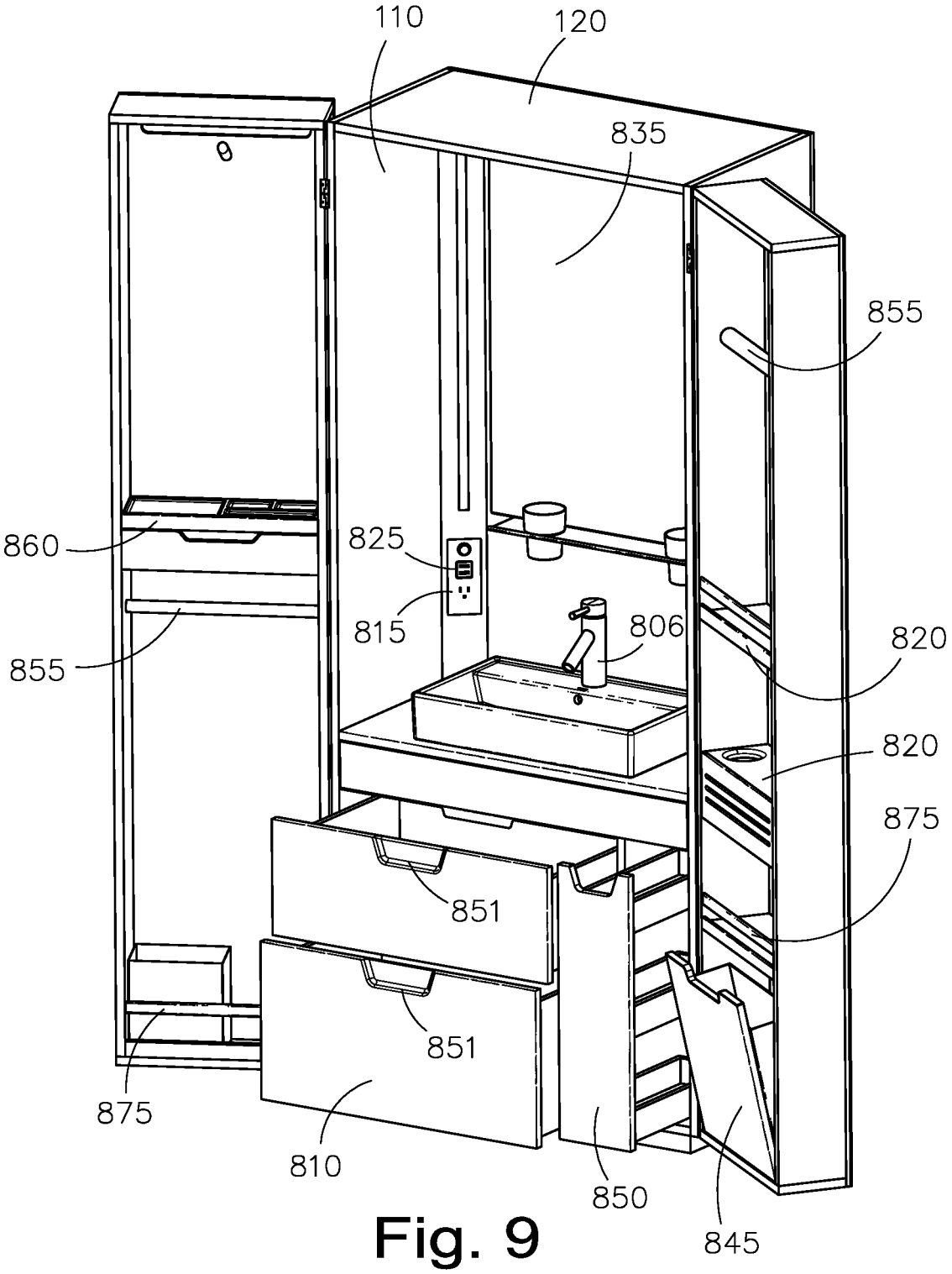
FIGS. 9 and 10 are perspective views of the furniture apparatus comprising double doors in an open position and having a plurality of drawers and a storage container in an open position, according to one embodiment.
Figure 10:
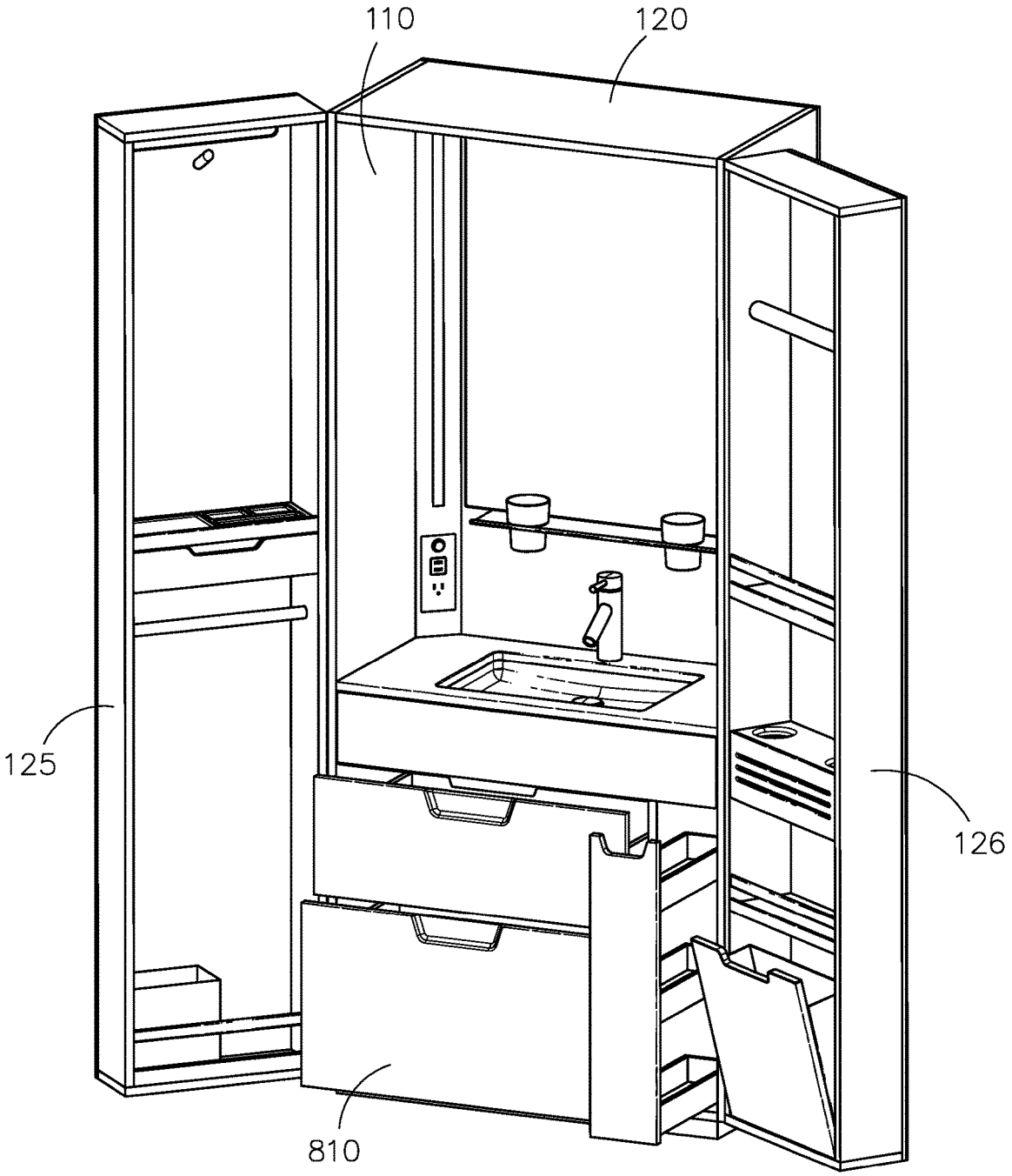

FIGS. 9 and 10 are perspective views of the furniture apparatus comprising double doors in an open position and drawers in an open position. In FIGS. 1-21, each of the doors comprise an elongated planar back panel 880 and a plurality of elongated planar side panels 881 (as well as top panels 883) positioned along the edge of the elongated planar back panel such that an interior volume 882 is defined.

The rectangular shaped housing is configured such that a plurality of items can be held within the housing. In the present embodiment, a washing vessel 805 is positioned within the housing. The washing vessel may be a sink installed within an opening in a rectangular planar divider or counter top 807 that is positioned within the housing. The washing vessel may comprise material such as porcelain, ceramic, tile, metal, aluminum, glass, brass, copper, or any combination thereof. Additionally, other materials may be used for the sink that are well known in the art and are within the spirit and scope of the invention. A faucet 806 is positioned proximate to the sink such that water can flow in the sink or washing vessel. Additionally, in all the embodiments disclosed herein, plumbing pipes and fittings may be used to connect an opening located in the bottom of the sink such that water can drain from the faucet. Additionally, openings (not shown) positioned on the back elongated planar panel of the housing may allow pipes or hoses to pass through such that the faucet may be connected to an external water source and drainage area (not shown) via a coupling (not shown).

The interior surface of the back panel of the housing is adapted such an electrical socket 815 can be positioned within the housing. The electrical socket 815 may be positioned above the washing vessel and may be connected to an external power source such that an individual using the furniture apparatus can connect devices requiring electrical power to the electrical socket. Additionally, an USB charging electrical socket 825 they also be located above the washing vessel and within the housing. Like the electrical socket the USB charging socket can be connected to an external power source. In other embodiments, the electrical socket may be positioned in other locations within the interior of the housing that are within the spirit and scope of the present invention. Such USB charging sockets and electrical sockets are well known to those skilled in the art.

Furniture apparatus the also include a plurality of drawers 810, 850 located under the washing vessel eight within the housing. The drawers below the washing vessel may be adapted such that the drawers can be slid in and out below the rectangular planar divider or counter 807. In FIG. 8, three drawers are located below the rectangular planar divider or countertop and within the housing. The drawers may comprise a plurality of planar shaped bodies that form a substantially rectangular shape (though this is not meant to be a limitation and serves only as an example of a shape) and have an open side. The drawers may be varied in shape and orientation in order to maximize the space as well as to provide storage for various size articles. Each of the drawers may also include a handle 851 such that the drawers may be moved between an open position and a closed position. The handle may be integral with the drawer or may be affixed to the body of the drawer using fasteners. Such drawer construction is well known to those skilled in the art is completed and within the spirit and scope of the invention.

The furniture apparatus may also include at least one storage shelf 820 located within an interior of each of the double doors. Storage self may comprise a planar shaped body having a flat surface such that items can be stacked on top of the storage shelf. The shelf may be horizontally aligned and positioned such that it spans from one side door panel to the opposing side door panel. Additionally, a rod 855 may be positioned such that the rod is horizontally aligned and spans across the interior of a door. In operation, a user may hook items, such as a clothing hanger having clothing within the interior of each of the double doors. In the present embodiments, the rod is circular or tubular shaped. Note that the interior of the doors, including the presence of closet-related accessories such as the rod 855, define a closet-like space for hanging clothing, storing items on shelves, etc. Further, the drawers 810, 850 provide the functionality of a conventional dresser drawer, the doors 125, 126 provide the functionality of a conventional closet and the sink 805 and faucet (and mirror 835) provide the functionality of a conventional vanity, such that apparatus 100 combines the functionality of a conventional dresser drawer, closet and vanity.

At least one drawer or storage container or caddy 845 may also be included positioned within the interior of at least one of the double doors. In the present embodiment, the caddy 845 is aligned such that the opening is on top. In the present embodiment, caddy 845 is opened by tilting the drawer outwards. (A caddy is a small storage container, typically one with divisions, used to store specific items, such as a hair dryer). The furniture apparatus may also include at least one storage container 870 within the interior of the door. Bars 875 spanning the interior of the door may assist in securing a storage container or other goods within the interior of the door as well as other articles that are placed on the shelf. A peg 840 protruding outward from the surface of the interior of a back panel of a door may be included. The peg may be configured or angled upwards such that clothing maybe hung on the peg. Additionally, a tray 860 having ridges or protrusions such that compartments are defined may be also included on one of the shelves positioned within the interior of doors. The compartments of the tray may be used to store loose items.

A mirror 835 may also be included within the rectangular shaped housing opposing the open side. In other embodiments, a storage shelf 890 may comprise cutouts 891 adapted to receive loose articles or storage containers. In other embodiments, the cutouts are adapted to receive cups or other containers. In operation, when the furniture apparatus is not being used, the storage containers within the drawers 810, 850 may be closed or pushed in below rectangular planar divider or the counter top such that the double doors may be closed without obstruction (as illustrated in FIGS. 8 and 11). Additionally, the drawers 845 within the double doors may be closed such that the double doors many closed without obstruction.

Figure 12:
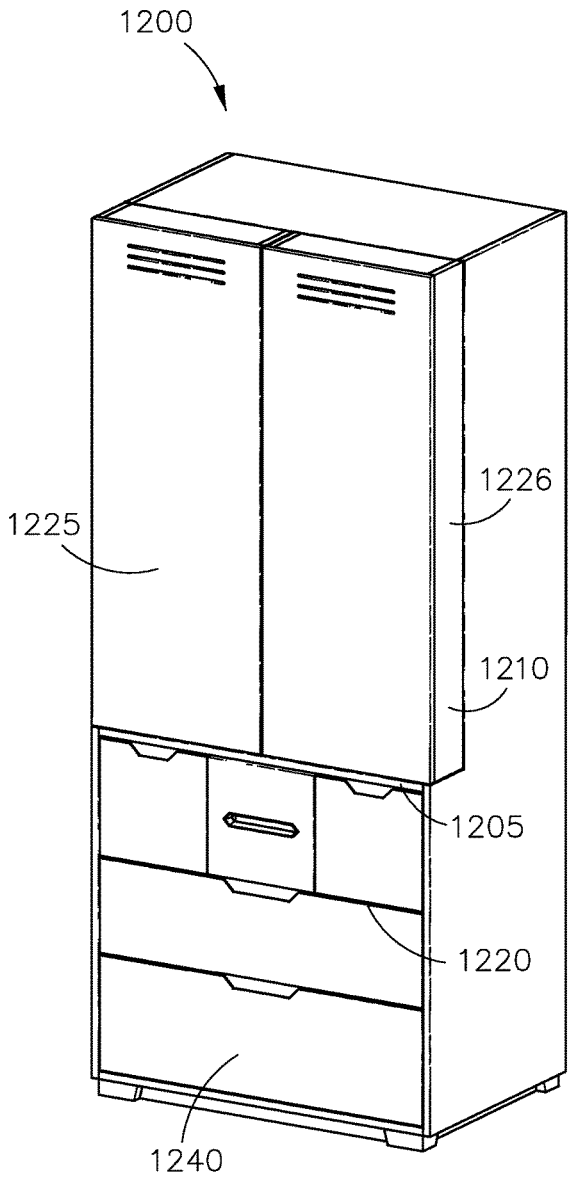
FIGS. 12 and 13 are perspective views of a second embodiment of a furniture apparatus comprising double doors and drawers in a closed position, according to another embodiment.
Figure 13:
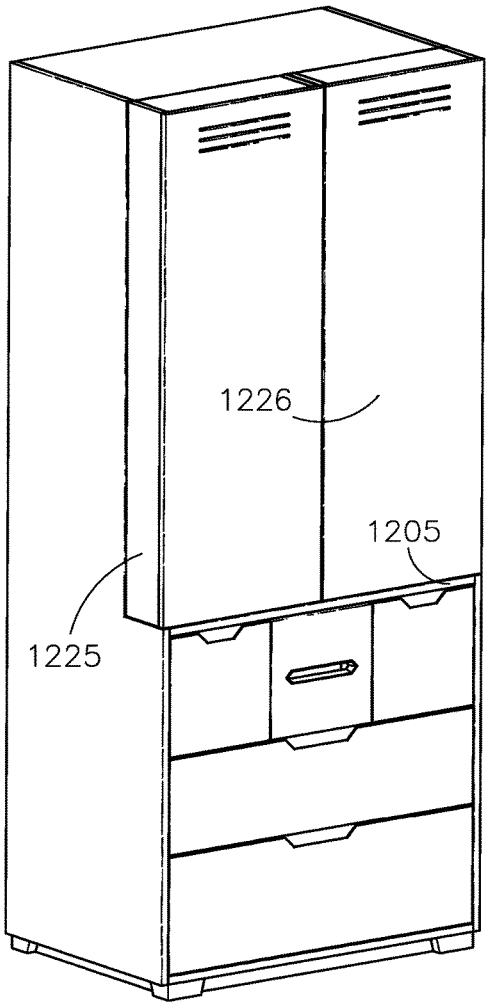
Figure 14:
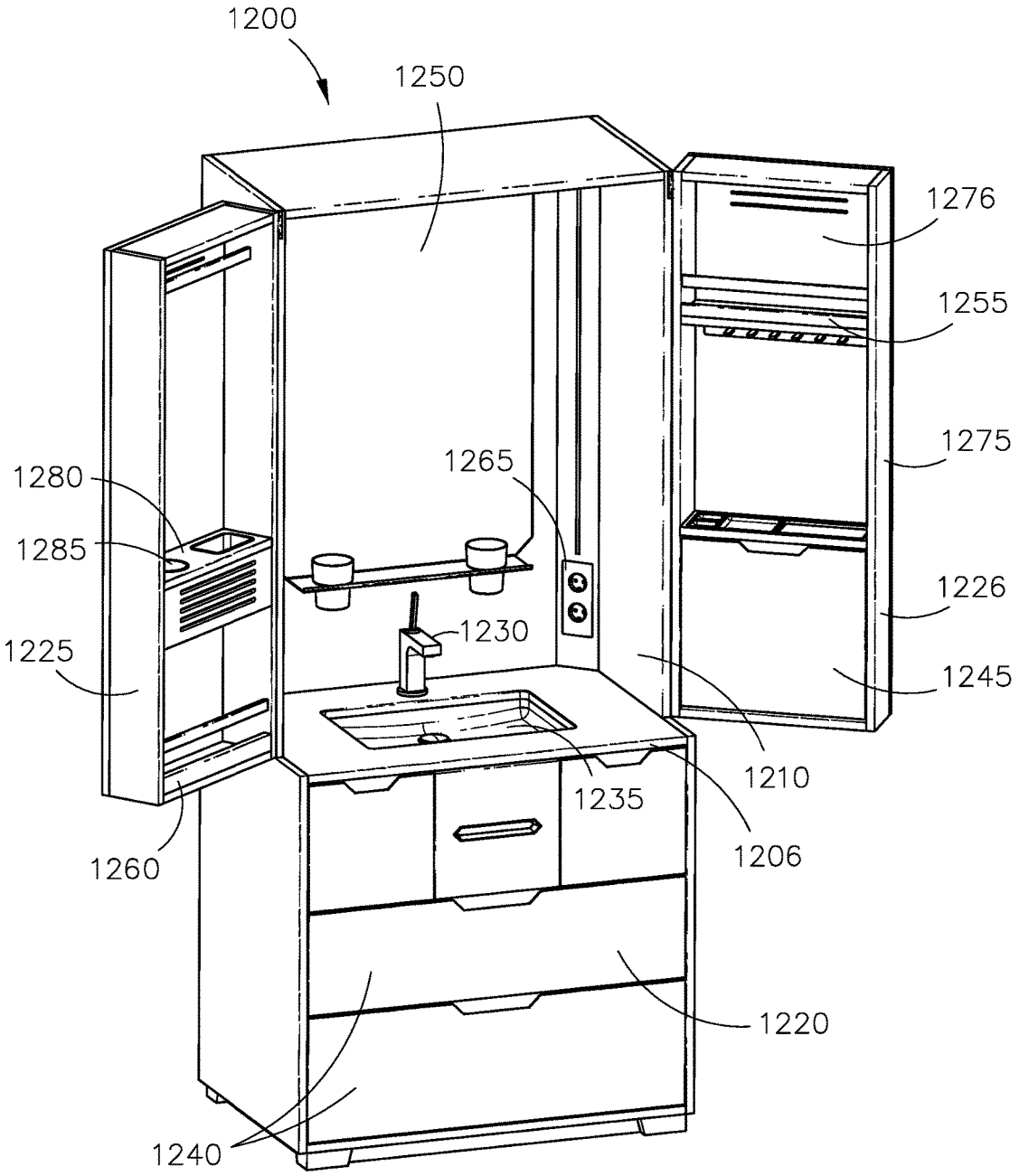
FIG. 14 is a perspective view of the second embodiment of the furniture apparatus comprising double doors in an open position and having drawers in a closed position, according to another embodiment.

FIGS. 12-17 comprise a second embodiment of said furniture apparatus 1200. FIGS. 12 and 13 are perspective views of a furniture apparatus 1200 comprising double doors 1225, 1226 in a closed position, according to another embodiment. The furniture apparatus has a rectangular shaped housing 1205. In FIGS. 12 and 13 the double doors do not span the entire front or open side of the housing. A planer horizontal divider or countertop 1206 divides the inner volume or interior of the housing into a top portion 1210 and a bottom portion 1220. A plurality of drawers 1240 are positioned within the bottom portion of the housing. Each of the drawers are adapted such that the drawers can be pulled out from the interior of the rectangular shaped housing (to the open position illustrated in FIG. 15) such that items can be inserted into the drawers and then push back into a closed position when not needed. As explained above, each of the drawers is a rectangular shaped container having an open on the top side.

Double doors are hingedly coupled to the housing and configured to move between an open position (illustrated in FIG. 15) and a closed position (illustrated in FIGS. 12 and 13). The bottom portion or section of the housing is unobstructed by the double doors. In the closed position, the double doors completely occlude the top portion of the housing. When the double doors are in the closed position, all components located with the top portion of the housing, and all components located within the interior of the double doors, are hidden from view for the exterior of the apparatus.

Figure 15:
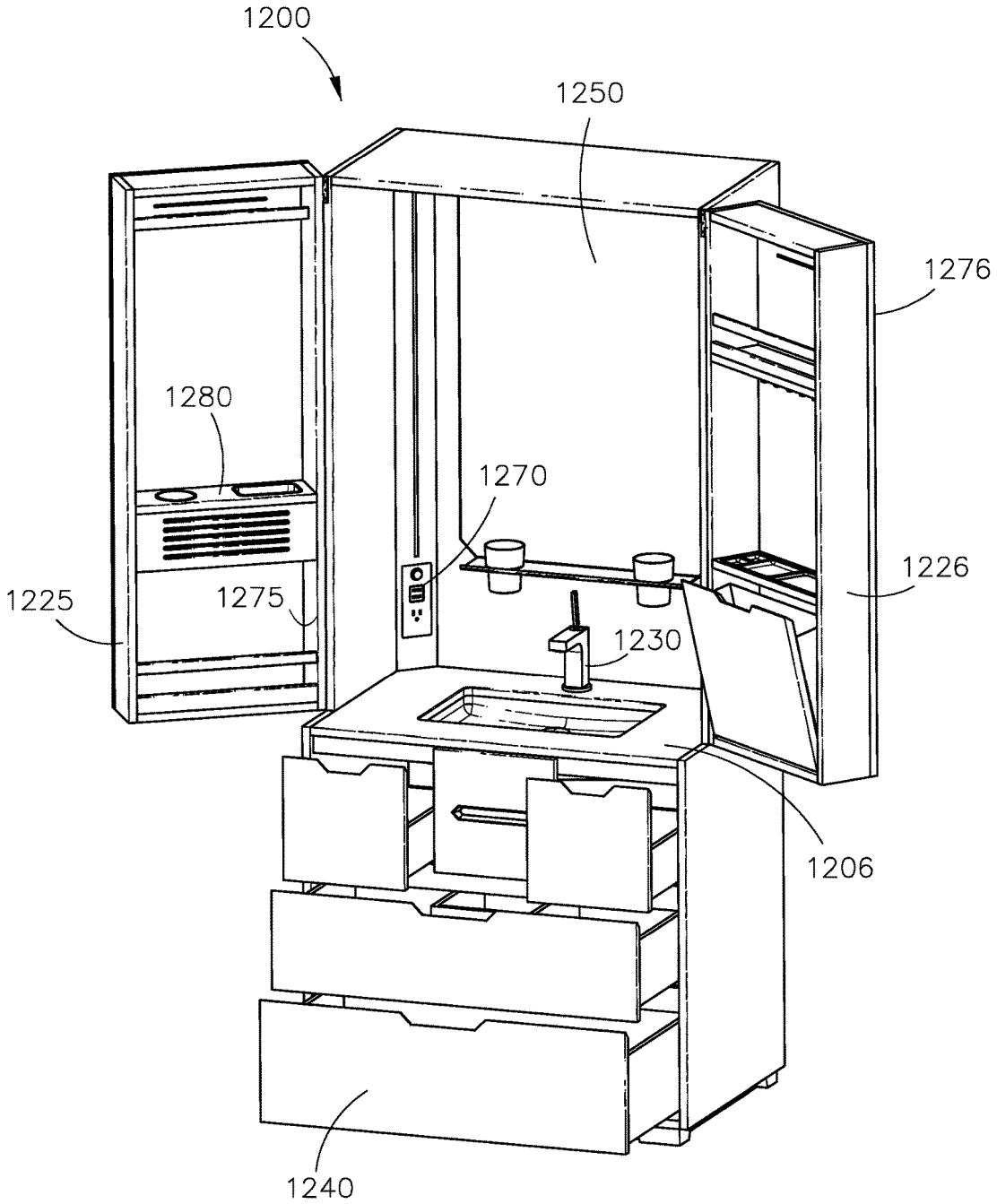
FIG. 15 is a perspective view of the second embodiment of the furniture apparatus comprising double doors in the open position and having drawers and a storage container in an open position, according to another embodiment.
Figure 16:
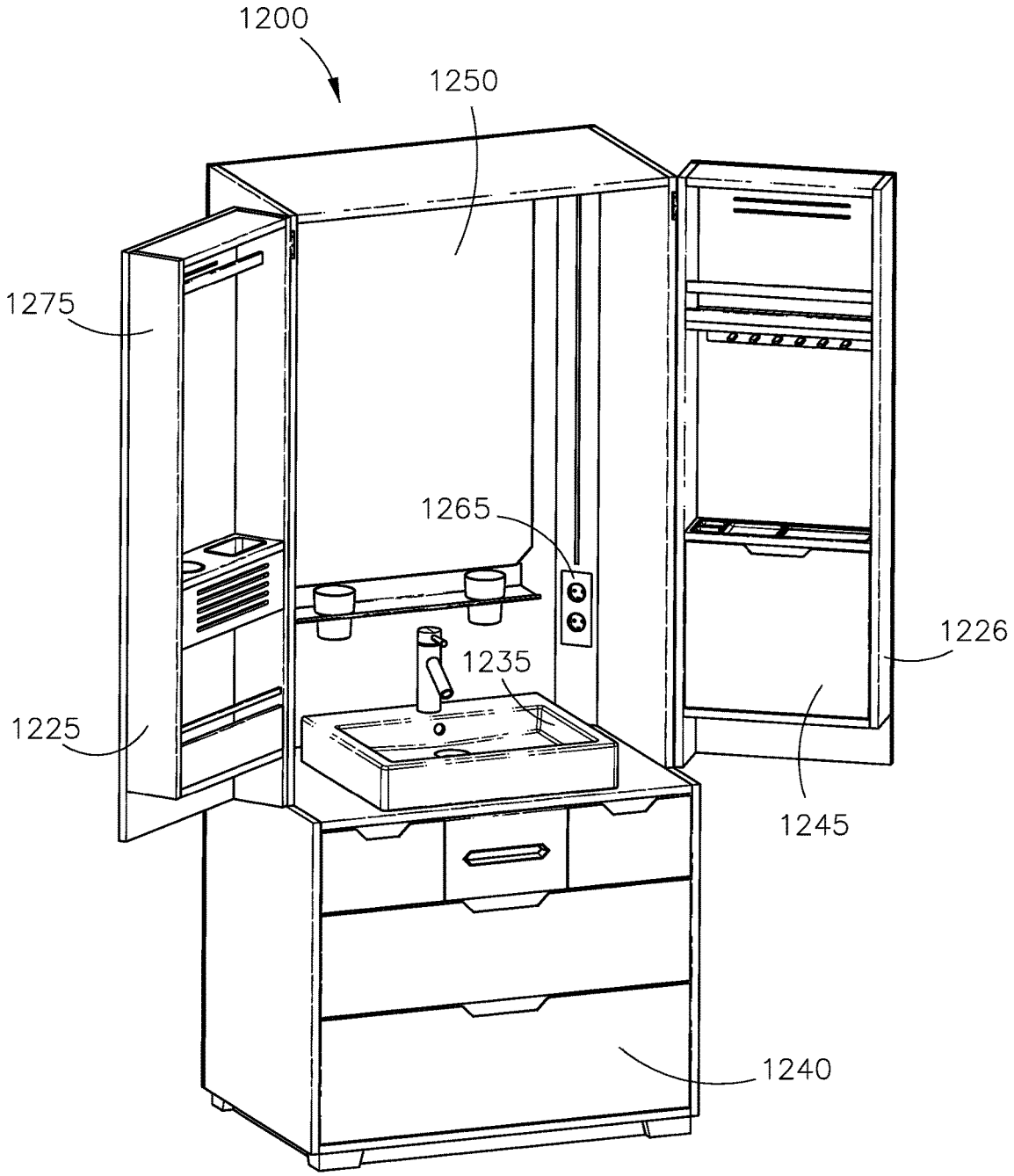
FIG. 16 is another perspective view of the second embodiment of the furniture apparatus comprising double doors in the open position and having drawers and a storage container in a closed position, according to another embodiment.

FIG. 15 is a perspective view of the furniture apparatus 1200 comprising double doors 1225, 1226 in an open position and having drawers 1240 in an open position. Each of the doors are adapted to have an interior formed by a plurality of elongated planar panels 1275 affixed to the edge of an elongated planar back door panel 1276. The interior of the doors have at least one storage shelf 1255. Each shelf can be a planar body horizontally aligned and that spans from one side door panel 1275 to another side door panel. The storage shelf may be adapted for receiving items placed on it. In other embodiments, bars 1260 may span from one door side panel to an opposing panel and above the shelf. Such bars may assist in retaining items on the shelf during operation of the furniture apparatus. Note that the interior of the doors, including the presence of closet-related accessories such as the bars and rods, define a closet-like space for hanging clothing, storing items on shelves, etc.

In other embodiments, other storage shelves 1280 may comprise cutouts 1285 adapted to receive loose articles or storage containers. In other embodiments, the cutouts are adapted to receive cups or other containers. In one embodiment, a storage container or caddy 1245 may be positioned within interior of the drawer. In the present embodiment, the drawer is positioned such that the opening of the container or drawer is upward facing. As illustrated in FIG. 15, the container may be opened by tilting the drawer such that the top or opening of the drawer extends beyond the panel door. However, in other embodiments, other types of storage containers may also be used.

The double doors comprise a first door hingedly coupled to a left side of the housing, and a second door hingedly coupled to a right side of the housing, wherein a vertical length of the first and second doors 1225, 1226 is coextensive with a vertical length of the top portion 1210 of the housing 1205. Similar to FIGS. 12 and 13, the double doors do not span the entire front or open side of the housing 1205.

The furniture apparatus may also include a washing vessel or a sink 1235 positioned on top of the horizontal planar divider or countertop 1206. A faucet 1230 may be included proximate to the sink such that water flows from the faucet into the sink. An opening 1285 at the bottom of the sink allows water fluid to flow from the sink. Such opening may be connected via hoses or pipes to an outside drainage location. An opening (not shown) in the rear panel of the rectangular shaped housing may be configured to allow hoses or pipes used to connect the sink to a drainage area and to connect a water supply to the faucet via a coupling. A mirror 1250 may also be affixed to the interior of the back panel of the top section 1210 of the housing.

Additionally, an electrical socket 1265 may be included within the interior of the rectangular shaped housing and affixed above the sink to the back panel of the housing. The socket 1265 also may be located in other positions within the interior of the housing. A USB charging socket 1270 may also be included in the interior of the top portion of the top section of the rectangular shaped housing. The sockets may be connected to an external power source. Such USB charging sockets and electrical sockets are well known to those skilled in the art.

Figure 17:
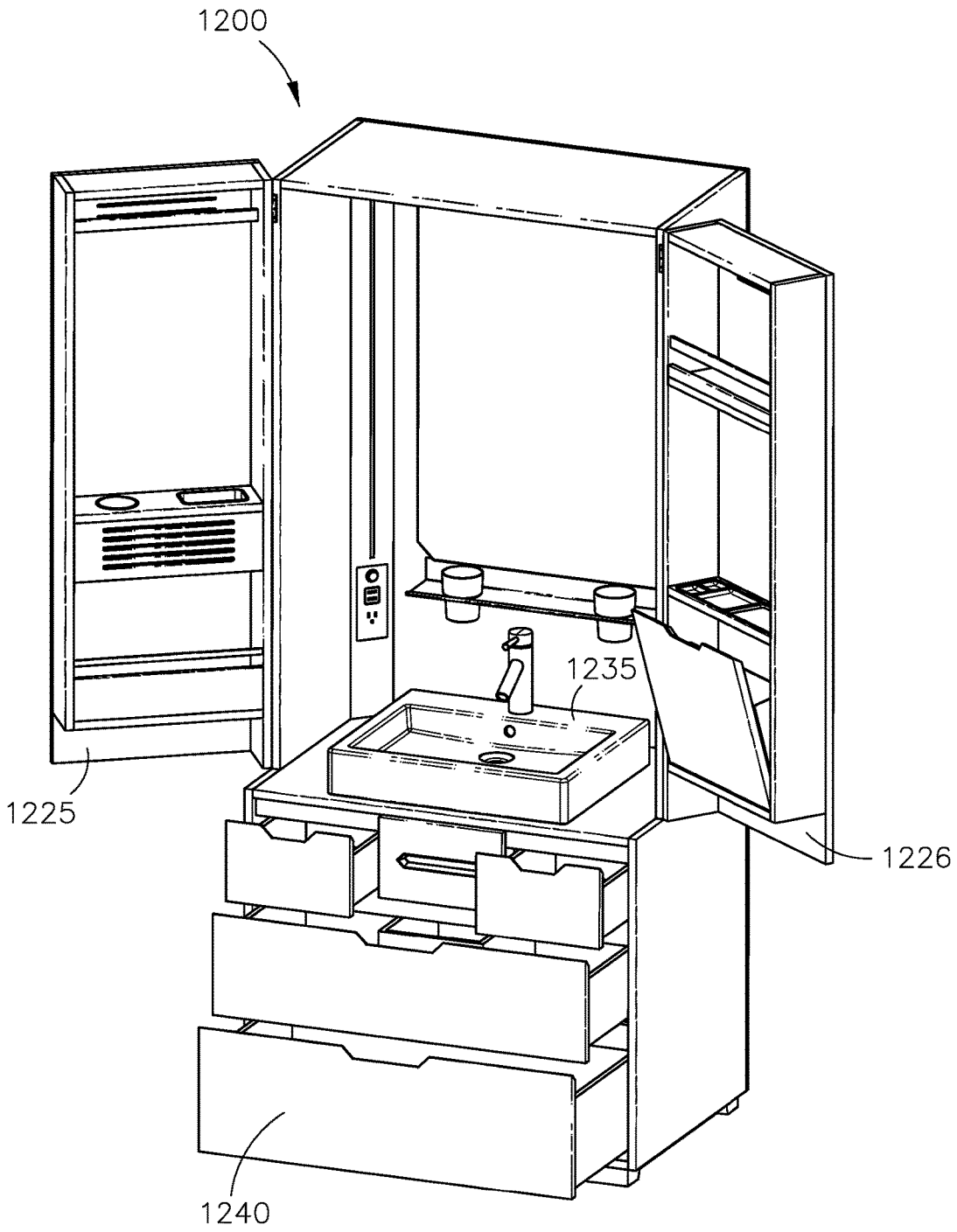
FIG. 17 is another perspective view of the second embodiment of the furniture apparatus comprising double doors in the open position and having drawers and a storage container in an open position, according to another embodiment

In FIG. 17, drawers 1240 are open or not fully inserted into the interior of the bottom section 1220 below the horizontal planar section 1205. The drawers may be positioned and configured such that the drawers may be pulled into and out of the bottom section of the housing. In the embodiment illustrated in FIG. 15, a portion of the sink is positioned above the horizontal planar surface. Additionally, FIG. 15 also illustrates that varying types of faucets may be used.

Figure 18:
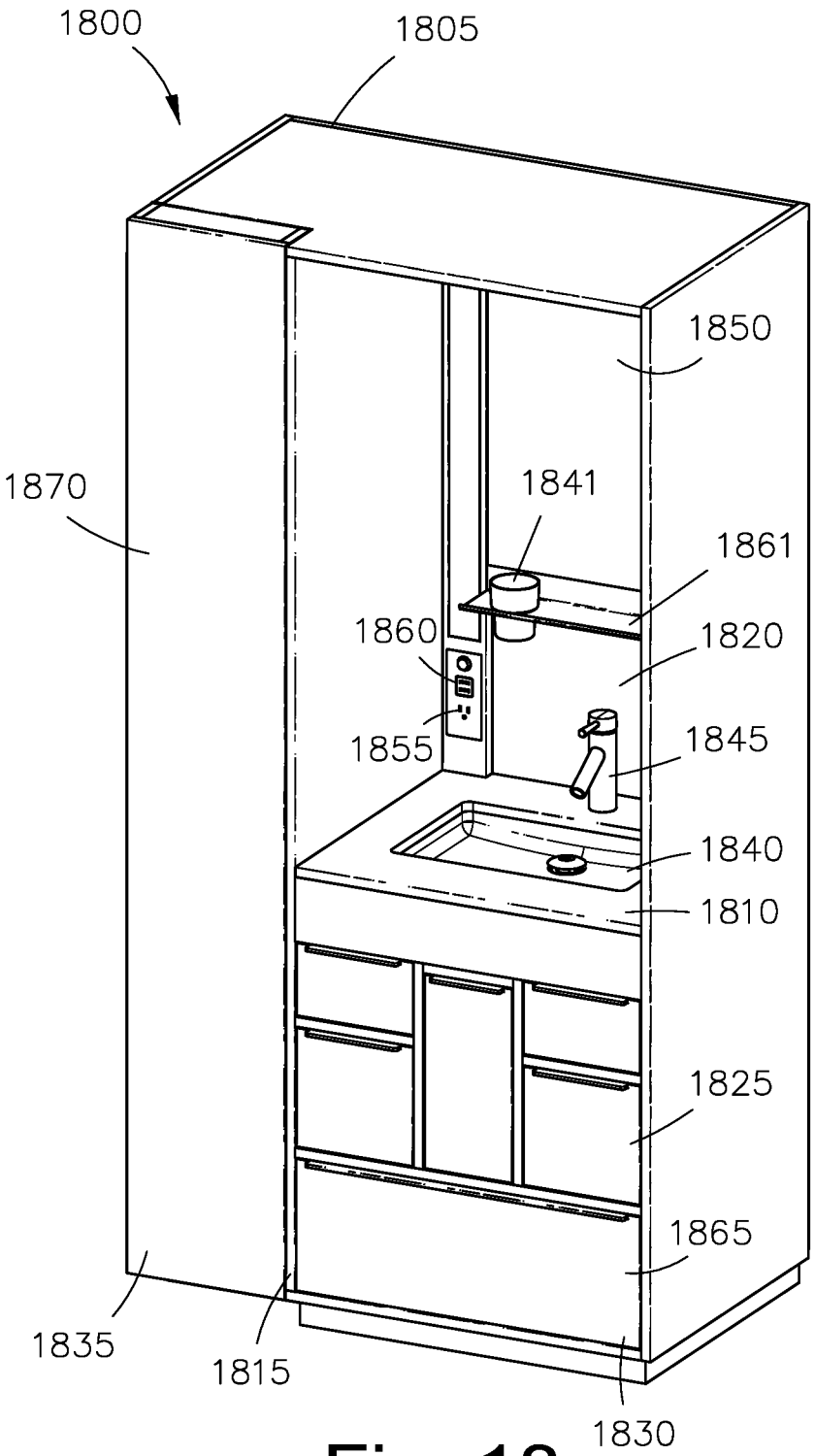
FIG. 18 is a perspective views of a third embodiment of a furniture apparatus comprising a door and drawers in a closed position, according to another embodiment.
Figure 19:
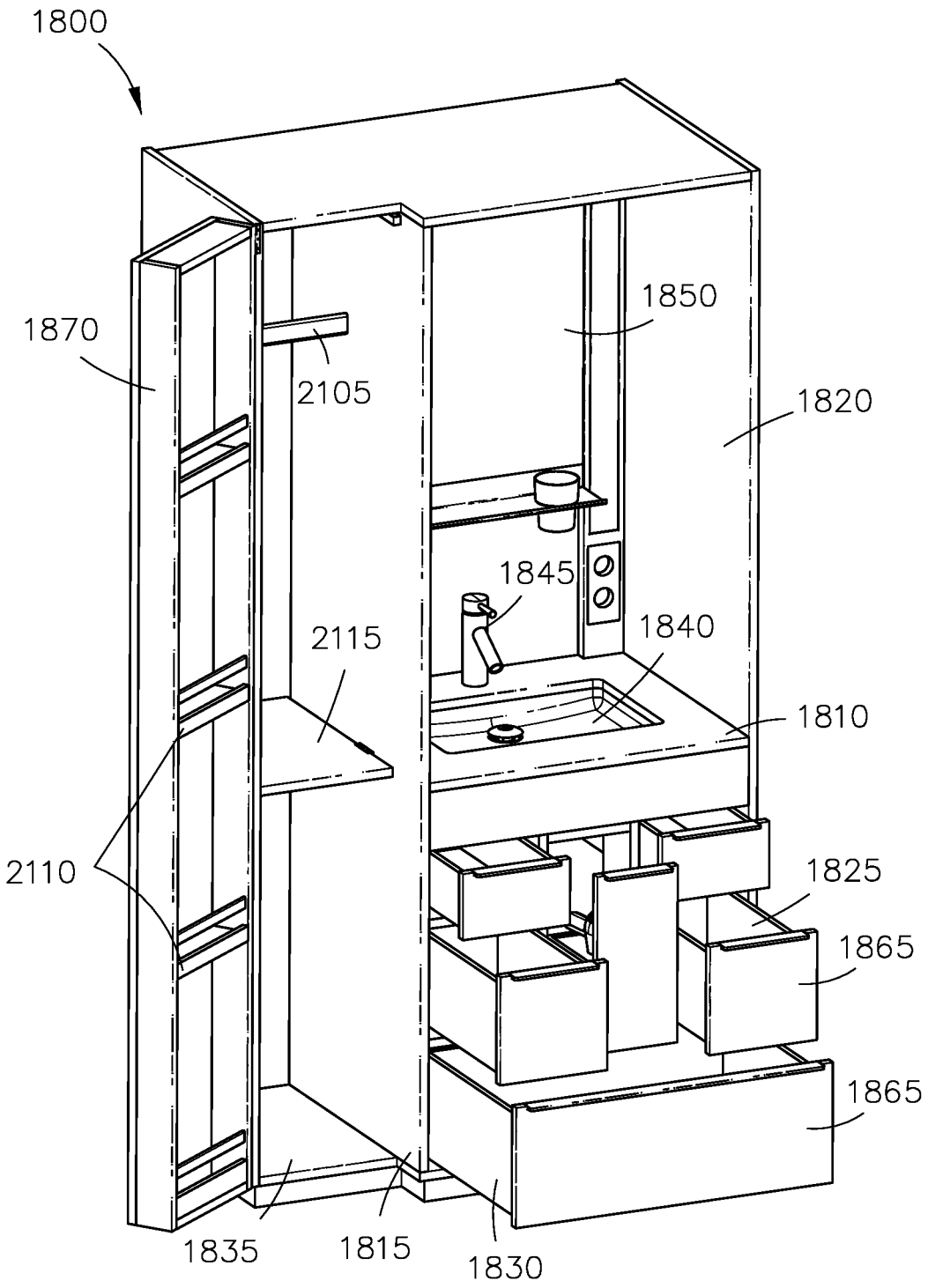
FIG. 19 is a perspective view of the third embodiment of the furniture apparatus comprising a door in an open position and having drawers and a storage container in an open position, according to another embodiment.
Figure 20:
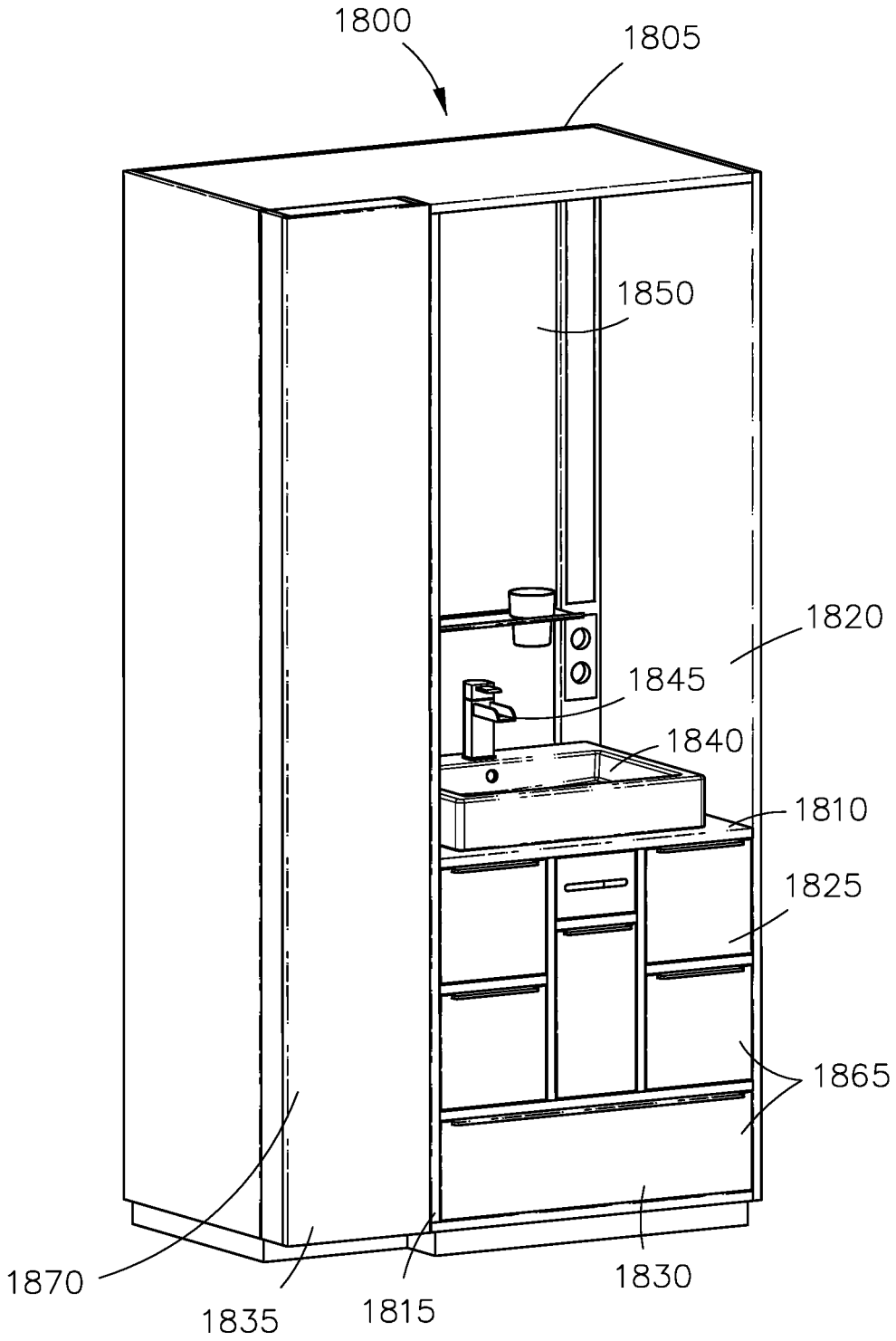
FIG. 20 is another perspective view of the third embodiment of the furniture apparatus comprising a door and drawers in a closed position, according to another embodiment.

FIGS. 18-21 comprise a third embodiment of said furniture apparatus 1800. FIG. 18 is a perspective view of a furniture apparatus 1800 having a substantially rectangular shaped housing 1805 having an open side or front. The housing has a vertical planar divider or panel 1815 that divides an inner volume of the housing into a left portion 1835 and a right portion 1830, wherein the left portion defines a closet-like space for hanging clothing, storing items on shelves, etc. In the present embodiment, the vertical planar divider is offset from the center of the rectangular shaped housing. However, in other embodiments the vertical planar divider may be positioned in other locations. The housing also comprises a horizontal planar divider or countertop 1810 that divides the right portion of the housing into a top section 1820 and a bottom section 1825. However, it is within the spirt and scope of the invention that horizontal divider can be positioned on the left side of the housing.

A mirror 1850 is positioned within the interior of the right side of the housing on the back panel of the housing. A washing vessel 1840 or sink is located within the top part of the housing. In the present embodiment, the sink or washing vessel is located in the right portion, however, it is within the spirt and scope of the invention that sink can be on the left side of the housing if the horizontal planar divider or counter is positioned on the left side of the housing. A faucet 1845 is positioned proximate to the washing vessel such that the faucet allows water to flow from an opening in the faucet into the washing vessel or sink. Additionally, a horizontally aligned planar shaped body 1861 or shelf can be positioned such that it protrudes or cantilevers out from the back panel of the right side of the housing. The shelf may comprises a cutout or opening such that a container, cup or glass 1841 can be received by the shelf 1861.

Similar to the other embodiments, plumbing may be included such that water can flow from an opening in the washing vessel through hoses or pipes installed within the housing and to an external drainage system. Electrical socket 1855 is positioned within the top portion on the back panel of the housing above the sink or washing vessel. Additionally, a USB charging electrical socket 1860 may also be included within the top portion of the housing. As mentioned above, the USB charging electrical socket and electrical socket may be connected to an external a power source such that power may be provided to electrical devices plugged into the sockets.

Furniture apparatus 1800 also includes a plurality of drawers 1865 located in the bottom portion of the housing. The size of the drawers may be varied depending on the size of the items to be placed within the drawers. Additionally, at least one container is located in the bottom portion of the housing. It is understood that the drawers and storage containers may be substituted for one another. In FIG. 18 the drawers are in a closed position. The drawers are configured such that they can be moved from a closed position to an open position. The installation and operation of such drawers are known to those skilled in the art. At least one drawer or storage container or caddy 1865 may also be included in the bottom portion of the housing.

A door 1870 is a hingedly coupled to the edge of a side panel of the housing. In FIG. 18 the door is in the closed position. The doors configured to move between an open position and a closed position (illustrated in FIG. 21). When in the closed position, the door completely occludes the left portion 1835 of the housing. When the door is in the closed position, all components located with the left portion 1835 of the housing, and all components located within the interior of the door, are hidden from view for the exterior of the apparatus.

Figure 21:
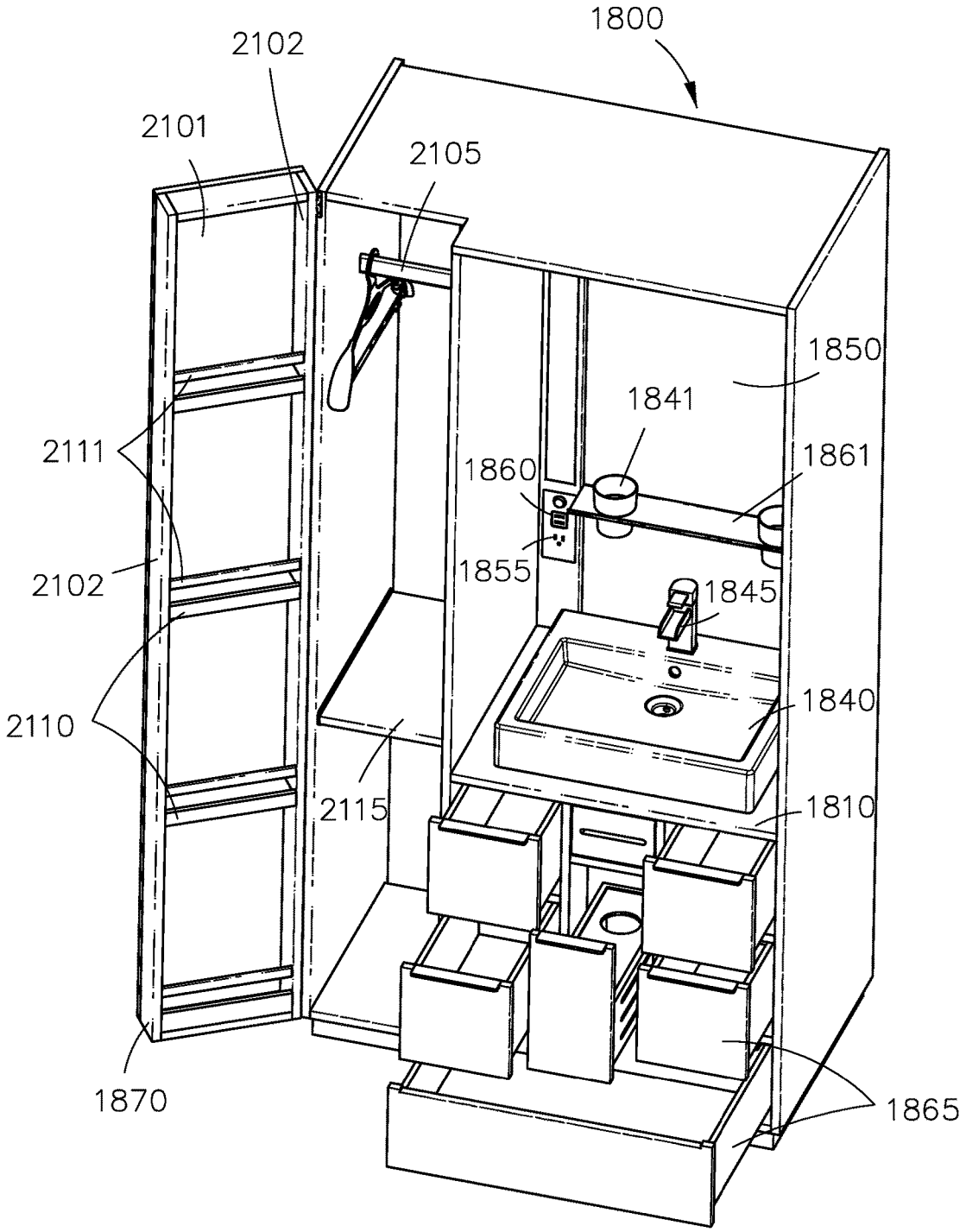
FIG. 21 is another perspective view of the third embodiment of the furniture apparatus comprising a door in the open position and having drawers and a storage container in an open position, according to another embodiment.

FIG. 21 is a perspective view of a furniture apparatus 1800 with the door 1870 in an open position. The door includes an elongated planar back panel 2101 and a plurality of elongated planar side panels 2102 positioned along the edge of the elongated panel such that an interior volume is defined. At least one shelf 2110 is located within the interior of the door. The shelf may be a planar body that is horizontally aligned spanning from one side door panel to the other door side panel. The shelf is configured above the shelf for allowing items to be placed on top of the shelf. A horizontal bar 2111 spanning from one side door panel 2102 to another side door panel 2102 may be positioned above the shelf to assist items placed on the shelf to remain on the shelf. The door 1870 is hingedly coupled to a left side of the housing, and a vertical length of the door is coextensive with a vertical length of the housing. Note that the drawers 1865 provide the functionality of a conventional dresser drawer, the door 1870 and space 1835 provide the functionality of a conventional closet and the sink 1840 and faucet (and mirror 1850) provide the functionality of a conventional vanity, such that apparatus 1800 combines the functionality of a conventional dresser drawer, closet and vanity.

A horizontally aligned rod 2105 may be positioned within the left portion of the housing and configured for hanging clothes hangers. The rod may comprise a cylindrical shaped body that spans span from one side of the interior to the opposing side of the interior of the housing. Additionally, at least one horizontally aligned planar shaped body or shelf 2115 may be positioned within the interior of the left side of the housing.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A furniture apparatus, comprising:

a rectangular shaped housing having an open side;

a horizontal planar divider that divides an inner volume of the housing into a top portion and a bottom portion;

a washing vessel, including a faucet, located within the top portion of the housing;

an electrical socket located within the top portion of the housing;

a plurality of drawers located within the bottom portion of the housing;

double doors hingedly coupled to the housing and configured to move between an open position, wherein the top portion of the housing is unobstructed by the double doors, and a closed position, wherein the double doors completely occlude the top portion of the housing and wherein the washing vessel and electrical socket are completely encased and hidden from view from an exterior of the furniture apparatus;

wherein the double doors comprise a first door hingedly coupled to a left side of the housing, and a second door hingedly coupled to a right side of the housing, wherein a vertical length of the first and second doors is coextensive with a vertical length of the top portion of the housing;

at least one storage shelf located within an interior of at least one of the double doors; and at least one storage container located within the interior of at least one of the double doors.

2. The furniture apparatus of claim 1, further comprising a USB charging electrical socket located within the top portion of the housing.

3. The furniture apparatus of claim 2, further comprising a mirror located within the top portion of the housing.

4. The furniture apparatus of claim 3, wherein when the double doors are in the closed position, the USB charging electrical socket and the mirror are also completely encased and hidden from view from the exterior of the furniture apparatus.

5. The furniture apparatus of claim 1, wherein when the double doors are in the closed position, the at least one storage shelf and the at least one storage container are also completely encased and hidden from view from the exterior of the furniture apparatus.

6. A furniture apparatus, comprising:

a substantially rectangular shaped housing having an open side;

a vertical planar divider that divides an inner volume of the housing into a left portion and a right portion;

a horizontal planar divider that divides the right portion of the inner volume of the housing into a top portion and a bottom portion;

a washing vessel, including a faucet, located within the top portion of the housing;

an electrical socket located within the top portion of the housing;

a plurality of drawers located in the bottom portion of the housing;

at least one storage container located in the bottom portion of the housing;

a horizontal rod located in the left portion of the housing, the rod for hanging clothes hangers;

a door hingedly coupled to the housing and configured to move between an open position, wherein the left portion is unobstructed by the door, and a closed position, wherein the door completely occludes the left portion and wherein any contents of the left portion are completely encased and hidden from view from an exterior of the furniture apparatus; and at least one storage shelf located within an interior of the door.

7. The furniture apparatus of claim 6, further comprising a USB charging electrical socket located within the top portion of the housing.

8. The furniture apparatus of claim 7, further comprising a mirror located within the top portion of the housing.

9. The furniture apparatus of claim 8, wherein when the door is in the closed position, the at least one storage shelf is also completely encased and hidden from view from the exterior of the furniture apparatus.

10. The furniture apparatus of claim 6, wherein the door is hingedly coupled to a left side of the housing, and wherein a vertical length of the door is coextensive with a vertical length of the housing.

11. The furniture apparatus of claim 10, wherein when the door is in the closed position, all components located within the left portion of the housing, and all components located within the interior of the door, are completely encased and hidden from view from the exterior of the apparatus.

* * * * *